US005749100A

United States Patent [19]

Rosenberg

[11] Patent Number: 5,749,100

[45] Date of Patent: May 12, 1998

[54] OPEN TOE SOCK

[76] Inventor: Iris Rosenberg, 203 Links Dr. West, Oceanside, N.Y. 11572

[21] Appl. No.: 727,000

[22] Filed: Oct. 7, 1996

[51] Int. Cl.[6] ..... A41B 11/00

[52] U.S. Cl. ..... 2/239; 2/409; 36/94; 36/106

[58] Field of Search ..... 2/239, 409; 36/87, 36/98, 102, 110, 7.1 R, 7.4, 7.3, 4, 10, 8.1, 14, 94, 106

[56] References Cited

U.S. PATENT DOCUMENTS

| | | | |
|---|---|---|---|
| D. 345,045 | 3/1994 | Atkins et al. | D2/916 |
| 1,074,594 | 10/1913 | Aumont | 36/8.1 |
| 1,999,229 | 4/1935 | Hearn | 2/239 |
| 2,179,124 | 11/1939 | Jesnig | 36/8.1 |
| 3,111,676 | 11/1963 | Artzt et al. | 2/239 |
| 3,329,972 | 7/1967 | Schwab et al. | 2/239 |
| 3,605,122 | 9/1971 | Myers | 2/239 |
| 4,181,982 | 1/1980 | Segovia | 2/239 |
| 4,322,894 | 4/1982 | Dykes | 36/8.1 |
| 5,054,129 | 10/1991 | Baehr | 2/409 |

FOREIGN PATENT DOCUMENTS

| | | | |
|---|---|---|---|
| 1211258 | 3/1960 | France | 2/239 |
| 2206004 | 9/1987 | Japan | 2/239 |
| 16140 | of 0000 | United Kingdom | 2/239 |

*Primary Examiner*—Gloria Hale

[57] ABSTRACT

An open toe sock that includes a foot engaging portion, a leg engaging portion, a thin resilient circumferential band, and a skid resistant sole. The foot engaging portion has a heel area, an open toe area that is disposed in front of the heel area of the foot engaging portion, and a bottom area that extends from the heel area of the foot engaging portion to the open toe area of the foot engaging portion. The foot engaging portion replaceably and comfortably engages a foot of a wearer with toes of the foot of the wearer extending replaceably outwardly through the open toe area of the foot engaging portion and being exposed. The leg engaging portion is integrally formed with, and extends generally perpendicularly upwardly from, the foot engaging portion, and replaceably and comfortably engages a leg of the wearer. The thin resilient circumferential band encircles the open toe area of the foot engaging portion, so that the open toe area engages the foot of the wearer when the toes of the foot of the wearer are past therethrough. And, the skid resistant sole extends along the bottom area of the foot engaging portion, from the open toe area of the foot engaging portion to the heel area of the foot engaging portion, so that the wearer of the open toe sock is prevent from slipping when walking and wear to the bottom area of the foot engaging portion is prevented.

2 Claims, 1 Drawing Sheet

OPEN TOE SOCK

CROSS REFERENCE TO RELATED APPLICATIONS

This application contains subject matter disclosed in applicant's Disclosure Document #397,723 filed May 10, 1996. As such, it is respectfully requested that this Disclosure Document be relied upon and remain a permanent part of the file history during the prosecution of the instant application and during any subsequent action thereof. As a result of the most recent submission date thereof, no Disclosure Document Number or filing date has yet been received, but will be graciously submitted when received, if the Examiner so requires.

BACKGROUND OF THE INVENTION

The present invention relates to an open toe sock. More particularly, the present invention relates to an open toe sock that includes a foot engaging portion with an open toe area, a leg engaging portion that is integrally formed with, and extends generally perpendicularly upwardly from, the foot engaging portion, a thin resilient circumferential band that encircles the open toe area of the foot engaging portion, and a skid resistant sole that extends along the entire bottom of the foot engaging portion.

Certain situations require that the toes of a person be exposed while the remainder of the foot be covered. For example, in pedicure applications, it is necessary to have access to the toes of the customer and allow the customer to walk while the polish is drying. Other examples include use with open toe shoes, and for medical procedures of the foot, such as, inter alia, the removal of bunions and ingrown toenails or the like, to name just a few.

Numerous innovations for open toe garments have been provided in the prior art that will be described. Even though these innovations may be suitable for the specific individual purposes to which they address, however, they differ from the present invention in that they do not teach an open toe sock that includes a foot engaging portion with an open toe area, a leg engaging portion that is integrally formed with, and extends generally perpendicularly upwardly from, the foot engaging portion, a thin resilient circumferential band that encircles the open toe area of the foot engaging portion, and a skid resistant sole that extends along the entire bottom of the foot engaging portion.

FOR EXAMPLE, U.S. Pat. No. Des. 343,947 to Coito et al. teaches an ornamental design for a pedicure slipper that includes a sole, a band extending upwardly from the sole and encircling the instep, a tong extending forwardly from the center of the band, and a pair of opposing wings extending outwardly from the point of intersection between the band and the tong.

ANOTHER EXAMPLE, U.S. Pat. No. Des. 345,045 to Atkins et al. teaches an ornamental design for a pedicure slipper that includes a sole, and a pair of tandem bands extending upwardly from the sole and encircling the instep.

STILL ANOTHER EXAMPLE, U.S. Pat. No. 1,999,929 to Hearn teaches an article of hosiery that includes a foot portion having a cut away toe, a base extending forwardly from the lower wall of the foot portion, flexible dividing elements disposed between the toes and extending substantially longitudinally from the forward edge of the base portion to the upper portion of the foot.

YET ANOTHER EXAMPLE, U.S. Pat. No. 3,111,676 to Artzt et al. teaches a foot construction for garments that includes top and bottom parts having front portions which are free of each other and define an opening therebetween, through which the wearer's foot can extend. The front portions of the top and bottom parts further have pockets opening generally rearwardly at the bottom and top sides, respectively, of such parts, so that the pockets can be nested in each other to close the front of the foot construction and thereby fully enclose the wearer's foot in the latter.

STILL YET ANOTHER EXAMPLE, U.S. Pat. No. 3,329,972 to Schwab et al. teaches a convertible toe infant garment that includes a body, a sole which is attached to the body except at the toe, a ribbed toe piece which can be worn either open or closed, and an instep cuff which closes the garment when the toe is open. In the closed position, the toe piece covers the toe while in the open position, it is folded under the sole of the foot.

YET STILL ANOTHER EXAMPLE, U.S. Pat. No. 3,605,122 to Myers teaches an elastic stocking that includes a foot engaging portion, and a leg engaging portion. The foot engaging portion is attached to the inner wall of the lower part of the leg engaging portion. The foot engaging portion permits insertion of the foot of the user therethrough. The leg engaging portion comprises a member having two longitudinal edges adapted to overlap when the member is wrapped around the leg of the user. The edges are provided with a continuous elongated complemental fastening strip. One of the elongated strips is affixed to the inner surface of the member and the other strip is affixed to the outer surface of the member.

STILL YET ANOTHER EXAMPLE, U.S. Pat. No. 4,181,982 to Segovia teaches a nylon stocking that includes a toe opening and inner and outer toe closing bands adjacent thereto. The inner band extends across the inside of the sole portion and the outer band extends over the toe portion. Each band is sewn at its ends to the sides of the stocking. From a closed position, with the toes extending under the inner band, the outer band is first pulled up and over the toes toward the instep, and the inner band is then pulled up and down under the toes, leaving the toes completely uncovered for taping, massaging, or the like.

FINALLY, YET STILL ANOTHER EXAMPLE, U.S. Pat. No. 5,054,129 to Baehr teaches an open toed, ventilated crotch, panty hose garment adapted for wear with swimsuits, exercise and dance clothing, and for post surgical wear. The garment entirely covers the lower body down to an edge that encircles the foot near the base of the toes and defines an opening through which the toes protrude. The upper and lower portions of the edge are bridged between the first and second toes and also between the fourth and fifth toes by straps which create a double tong effect and provide means to distribute the securing load for comfort, permitting the wearer to maintain the foot portion in position and keep the pantyhose taut on the body, even when wet. The garment may also be modified for post surgical wear.

It is apparent that numerous innovations for open toe garments have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an open toe sock that avoids the disadvantages of the prior art.

ANOTHER OBJECT of the present invention is to provide an open toe sock that is simple and inexpensive to manufacture.

STILL ANOTHER OBJECT of the present invention is to provide an open toe sock that is simple to use.

YET ANOTHER OBJECT of the present invention is to provide an open toe sock that is used to keep the foot covered while allowing the toes to be exposed.

STILL YET ANOTHER OBJECT of the present invention is to provide an open toe sock that can be used, inter alia, for pedicure and medical purposes.

YET STILL ANOTHER OBJECT of the present invention is to provide an open toe sock that allows a wearer having a pedicure to walk around while the polish is drying.

BRIEFLY STATED, STILL YET ANOTHER OBJECT of the present invention is to provide an open toe sock that includes a foot engaging portion, a leg engaging portion, a thin resilient circumferential band, and a skid resistant sole.

YET STILL ANOTHER OBJECT of the present invention is to provide an open toe sock wherein the foot engaging portion has a heel area, an open toe area that is disposed in front of the heel area of the foot engaging portion, and a bottom area that extends from the heel area of the foot engaging portion to the open toe area of the foot engaging portion.

STILL YET ANOTHER OBJECT of the present invention is to provide an open toe sock wherein the foot engaging portion replaceably and comfortably engages a foot of a wearer with toes of the foot of the wearer extending replaceably outwardly through the open toe area of the foot engaging portion and being exposed.

YET STILL ANOTHER OBJECT of the present invention is to provide an open toe sock wherein the leg engaging portion is integrally formed with, and extends generally perpendicularly upwardly from, the foot engaging portion, and replaceably and comfortably engages a leg of the wearer.

STILL YET ANOTHER OBJECT of the present invention is to provide an open toe sock wherein the thin resilient circumferential band encircles the open toe area of the foot engaging portion, so that the open toe area of the foot engaging portion engages the foot of the wearer when the toes of the foot of the wearer are past therethrough.

YET STILL ANOTHER OBJECT of the present invention is to provide an open toe sock wherein the skid resistant sole extends along the bottom area of the foot engaging portion, from the open toe area of the foot engaging portion to the heel area of the foot engaging portion, so that the wearer of the open toe sock is prevented from slipping when walking while wear to the bottom area of the foot engaging portion is prevented.

STILL YET ANOTHER OBJECT of the present invention is to provide an open toe sock wherein the foot engaging portion and the leg engaging portion are a stretchable material, so that the open toe sock can fit multiple size wearers.

YET STILL ANOTHER OBJECT of the present invention is to provide an open toe sock wherein the stretchable material is knitted.

STILL YET ANOTHER OBJECT of the present invention is to provide an open toe sock wherein the thin resilient circumferential band, that encircles the open toe area of the foot engaging portion, is a stretchable material.

YET STILL ANOTHER OBJECT of the present invention is to provide an open toe sock wherein the stretchable material is rubberized.

YET STILL ANOTHER OBJECT of the present invention is to provide an open toe sock wherein the stretchable material is silicon, so that when the open toe sock is used in a pedicure application, polish is repelled from sticking thereto so as to provide a clean look therefor.

STILL YET ANOTHER OBJECT of the present invention is to provide an open toe sock wherein the skid resistant sole on the bottom area of the foot engaging portion is stretchable, so that the open toe sock is prevented from riding up the foot of the wearer when donned.

YET STILL ANOTHER, OBJECT of the present invention is to provide an open toe sock wherein the stretchable material is rubberized.

FINALLY, STILL YET ANOTHER OBJECT of the present invention is to provide an open toe sock wherein the stretchable material is silicon, so that debris is repelled from sticking to the skid resistant sole on the bottom area of the foot engaging portion when the wearer of the open toe sock is walking so as to provide a clean look therefor.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawing.

BRIEF DESCRIPTION OF THE DRAWING

The sole FIGURE of the drawing is briefly described as a perspective view illustrating the present invention donned on a foot and a leg of a wearer with the toes of the foot of the wearer extending outwardly therefrom and being exposed.

LIST OF REFERENCE NUMERALS UTILIZED IN THE DRAWING

Figure 1:
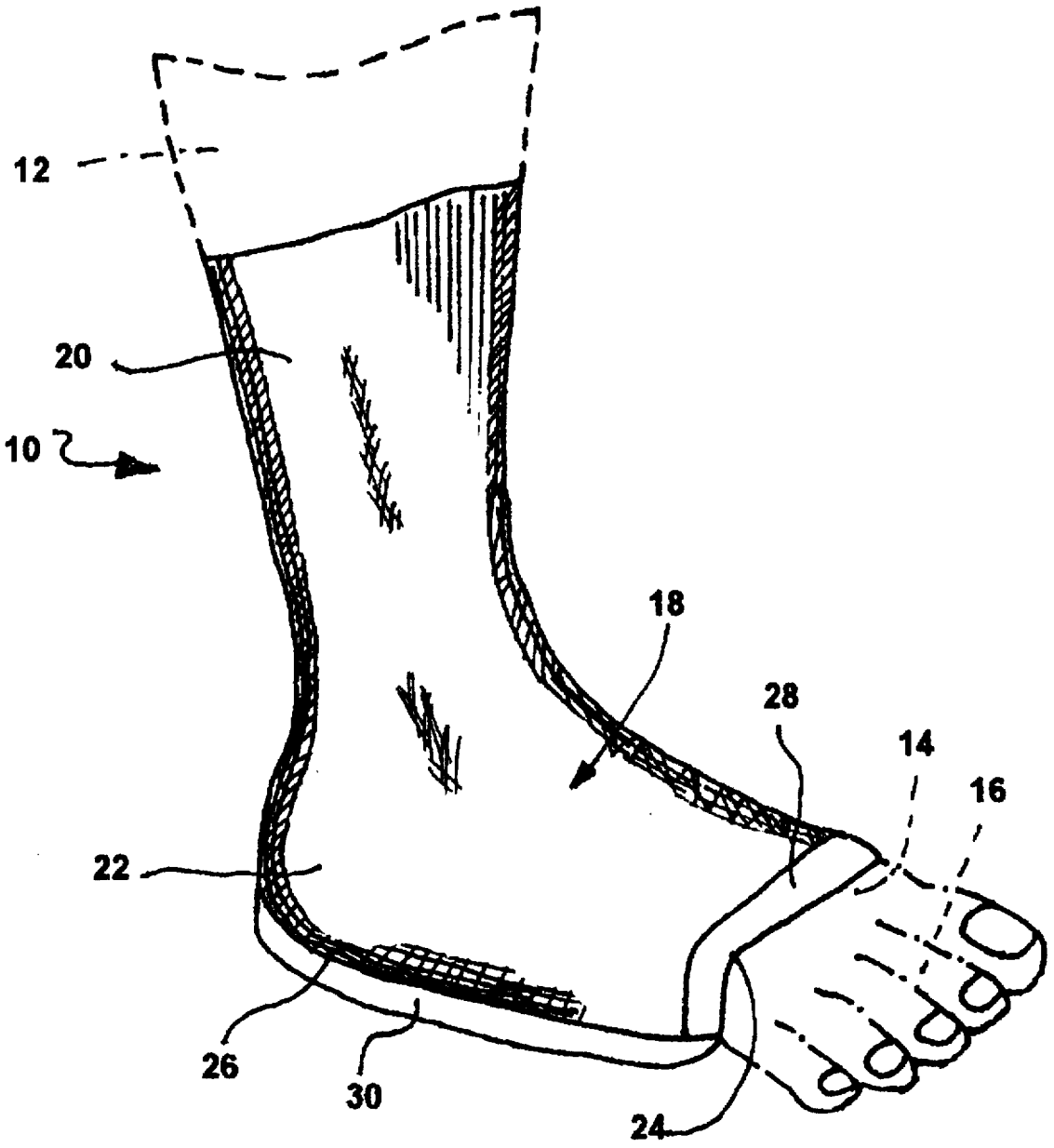

10 open toe sock of the present invention

12 wearer leg

14 wearer foot

16 wearer foot toes

18 foot engaging portion

20 leg engaging portion

22 foot engaging portion heel area

24 foot engaging portion open toe area

26 foot engaging portion bottom area

28 foot engaging portion open toe area thin resilient circumferential band

30 foot engaging portion bottom area resilient sole

DETAILED DESCRIPTION OF THE PREFERRED EMBODIMENT

Referring now to the sole figure, which is a perspective view illustrating the present invention donned on a foot and a leg of a wearer with the toes of the foot of the wearer extending outwardly therefrom and being exposed, the open toe sock of the present invention is shown generally at 10 donned on a wearer leg 12 and a wearer foot 14, with wearer foot toes 16 of the wearer foot 14 extending outwardly therefrom and being exposed.

The open toe sock 10 includes a foot engaging portion 18 and a leg engaging portion 20 that is integrally formed with, and extends generally perpendicularly upwardly from, the foot engaging portion 18, as does a conventional sock.

The foot engaging portion 18 and the leg engaging portion 20 are preferably a knitted, stretchable material, so as to fit multiple size wearers.

The foot engaging portion 18 replaceably and comfortably engages the wearer foot 14 while the leg engaging portion 20 replaceably and comfortably engages the wearer leg 12, as does a conventional sock.

The foot engaging portion 18 has a foot engaging portion heel area 22, a foot engaging portion open toe area 24 that is disposed in front of the foot engaging portion heel area 22 of the foot engaging portion 18, and a foot engaging portion bottom area 26 that extends from the foot engaging portion open toe area 24 of the foot engaging portion 18 to the foot engaging portion heel area 22 of the foot engaging portion 18.

The open toe sock 10 further includes a foot engaging portion open toe area thin resilient circumferential band 28 that encircles the foot engaging portion open toe area 24 of the foot engaging portion 18.

The foot engaging portion open toe area thin resilient circumferential band 28, that encircles the foot engaging portion open toe area 24 of the foot engaging portion 18, is preferably a stretchable, rubberized, knitted, or silicon material.

The stretchable, rubberized, or knitted material of the foot engaging portion open toe area thin resilient circumferential band 28, that encircles the foot engaging portion open toe area 24 of the foot engaging portion 18, allows the entire foot engaging portion open toe area 24 to engage the wearer foot toes 16 of the wearer foot 14 when the wearer foot toes 16 of the wearer foot 14 are past through the foot engaging portion open toe area 24 of the foot engaging portion 18.

The silicon material of the foot engaging portion open toe area thin resilient circumferential band 28, that encircles the foot engaging portion open toe area 24 of the foot engaging portion 18, repels pedicure products, such as polish or the like from sticking thereto so as to provide a clean look therefor, when the open toe sock 10 is used in a pedicure application.

The open toe sock 10 further includes a foot engaging portion bottom area resilient sole 30 that extends along the foot engaging portion bottom area 26 of the foot engaging portion 18, from the foot engaging portion open toe area 24 of the foot engaging portion 18 to the foot engaging portion heel area 22 of the foot engaging portion 18, also, this thin resilient sole 30 may be configured in any desirable pattern, such as: a solid uninterrupted sheet; a grouping of separate spaced beads; a series of separate spaced rows or even an artistic form such as a logo or other graphic display.

The foot engaging portion bottom area resilient sole 30, that covers the foot engaging portion bottom area 26 of the foot engaging portion 18, is preferably a skid resistant, stretchable, rubberized, or silicon material.

It will be understood that each of the elements described above, or two or more together, may also find a useful application in other types of constructions differing from the types described above.

While the invention has been illustrated and described as embodied in an open toe sock, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An open toe sock, comprising:

a) a foot engaging portion having a heel area, an open toe area being disposed in front of said heel area of said foot engaging portion, and a bottom area extending from said heel area of said foot engaging portion to said open toe area of said foot engaging portion; said foot engaging portion replaceably and comfortably engaging a foot of a wearer with toes of the foot of the wearer extending replaceably outwardly through said open toe area of said foot engaging portion and being exposed;

b) a leg engaging portion being integrally formed with, and extending generally perpendicularly upwardly from, said foot engaging portion, and replaceably and comfortably engaging a leg of the wearer;

c) said foot and leg engaging portions formed of a non-silicon-fabric material;

d) a thin resilient circumferential band encircling said open toe area of said foot engaging portion so as to allow said open toe area of said foot engaging portion to engage the foot of the wearer when the toes of the foot of the wearer are passed therethrough; said thin resilient circumferential band being silicon so as to repel polish from sticking to said open toe sock when used in a pedicure application and thereby providing a clean look therefor; and e) a skid resistant sole extending continuously along said bottom area of said foot engaging portion, from said open toe area of said foot engaging portion to said heel area of said foot engaging portion so as to prevent the wearer of said open toe sock from slipping when walking and wear to said bottom area of the foot engaging portion is prevented; said skid resistant sole being silicon so as to repel debris from sticking to said skid resistant sole on said bottom area of said foot engaging portion when the wearer of said open toe sock is walking.

2. The sock as defined in claim 1, wherein said foot engaging portion and said leg engaging portion are knitted so as to allow said open toe sock to fit multiple size wearers.

* * * * *